US006013328A

United States Patent [19]

Rojdev

[11] Patent Number: 6,013,328

[45] **Date of Patent: *Jan. 11, 2000**

[54] ELECTROLESS METHOD OF ANTIQUING A PEWTER COMPONENT

[75] Inventor: Ilija Rojdev, Fairfield, Ohio

[73] Assignee: Batesville Casket Company, Batesville, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/426,494

[22] Filed: Apr. 20, 1995

[51] Int. Cl.[7] ..... B05D 1/18; B05D 3/02; B05D 3/12; C23C 8/80

[52] U.S. Cl. ..... 427/443.1; 427/327; 427/368; 427/376.8; 148/277; 148/284

[58] Field of Search ..... 427/327, 368, 427/376.8, 437, 443.1; 148/277, 284, 441, DIG. 118

[56] References Cited

U.S. PATENT DOCUMENTS

| | | | |
|---|---|---|---|
| 3,615,747 | 10/1971 | Friedman | 106/19 |
| 3,767,475 | 10/1973 | Schubert | 148/6.14 |
| 4,368,237 | 1/1983 | Yamada et al. | 428/413 |
| 4,863,516 | 9/1989 | Mosser et al. | 106/14.12 |
| 5,196,665 | 3/1993 | Briffod | 219/69.12 |
| 5,463,800 | 11/1995 | Rojdev | 27/1 |
| 5,519,923 | 5/1996 | Rojdev | 27/1 |

OTHER PUBLICATIONS

Publication, *Metal Finishing*, "Metal Blackeners and Antiquing Solutions", Electrochemical Products, Inc. (EPI), p. 77, Mar., 1995.

Technical Data Sheet, Electrochemical Products, Inc. (EPI), 17000 Lincoln Avenue, New Berlin, WI 53151–2781, Feb. 1990.

Material Safety Data Sheet, Electrochemical Products, Inc. (EPI), 17000 Lincoln Avenue, New Berlin, WI 53151–2781, Feb. 1990.

*Primary Examiner*—Shrive Beck
*Assistant Examiner*—Michael Barr
*Attorney, Agent, or Firm*—Wood, Herron & Evans, L.L.P.

[57] ABSTRACT

This invention is directed to an electroless method of antiquing a zinc or pewter component and to products produced using the method. In its simplest form, the method includes: contacting the metal component with an oxidizing solution; rinsing the metal component to stop the formation of additional oxide; and buffing the component to achieve the desired antique look. In a preferred form of the invention, the oxidizing solution includes copper chloride, selenious acid, hydrochloric acid and sodium tetradecyl sulfate. The preferred method further includes various cleaning, rinsing and drying steps, as well as the application of a protective lacquer or other coating to seal the oxide formed on the metal component.

21 Claims, No Drawings

ELECTROLESS METHOD OF ANTIQUING A PEWTER COMPONENT

BACKGROUND OF THE INVENTION

This invention relates to methods of antiquing a metal surface, and more particularly, to electroless methods of antiquing a zinc or pewter metal component.

Several different methods may be used to form an antique finish or appearance on a metal surface such as zinc or pewter. For example, traditional electroplating may be used, in which a copper or nickel coating is electroplated onto the zinc or pewter metal surface. If a copper coat is applied initially, it is usually followed by a nickel coating. Then in a separate step, the electroplated metal component is submersed in another solution, such as a solution of caustic etching chemicals in order to form the antiqued surface. In another antiquing method, paint, such as a black or brown lacquer-type paint, may be sprayed onto the metal component. After this initial spraying step, the paint is wiped off in order to achieve the desired antique finish. In yet another antiquing method, the. metal component may be vacuum metalized. In this method, a base coat such as a lacquer is applied to the zinc or pewter metal component, and then the component is coated with aluminum or copper ions in a vacuum. After this vacuum metalizing step, the component is painted and the paint is wiped off to create the antique finish.

Although each of these methods produces an antiqued metal surface, the methods have several limitations. For example, the electroplating process is expensive because several different solutions are required. In addition, the chemicals used in the electroplating solutions and antiquing solutions are subject to stringent EPA and OSHA regulations and must go through costly predisposal treatment. The painting and vacuum metalizing methods also are quite costly because the chemicals used must meet stringent federal regulations as well. In addition, the vacuum metalizing method involves the added cost of providing a vacuum metalizing chamber.

Therefore, it is desirable to have a method of antiquing a zinc or pewter component which is safe and relatively inexpensive and easy to use.

SUMMARY OF THE INVENTION

This invention is directed to a method of antiquing a zinc or pewter component as well as to products produced using the method. In its simplest form, the method includes: oxidizing the component by contacting the component with an oxidizing solution; rinsing the component to stop the formation of oxide; and buffing the component to form an antique finish on the component.

The oxidizing solution includes an acid salt of copper, selenious acid, hydrochloric acid and a surface activator. Preferably the acid salt of copper is copper chloride and the surface activator is sodium tetradecyl sulfate. The oxidizing solution preferably includes from about 0.3% to about 10% by weight copper chloride, from about 0.17% to about 1.9% by weight selenious acid, from about 0.2% to about 1.6% by weight hydrochloric acid, and from about 0.003% to about 0.10% by weight sodium tetradecyl sulfate, with the balance being water. More preferably, the oxidizing solution comprises from about 1.0% to about 3.1% by weight copper chloride, from about 0.37% to about 1.1% by weight selenious acid, from about 0.33% to about 1.0% by weight hydrochloric acid and from about 0.02% to about 0.05% by weight sodium tetradecyl sulfate, with the balance being water. In another more preferred form, the oxidizing solution includes about 1.0% by weight copper chloride, about 0.37% by weight selenious acid, about 0.33% by weight hydrochloric acid, and about 0.02% by weight sodium tetradecyl sulfate, with the balance being water. If this latter form of the oxidizing solution is used, the metal component typically is submersed in the oxidizing solution for about 25 seconds.

In the rinsing step, the component preferably is rinsed with hot water having a temperature of from about 175° F. to about 180° F. for about 30 seconds.

If desired, additional steps may be added to the basic antiquing process discussed above. For example, the method may include the step of cleaning the component prior to the oxidizing step. Preferably, this cleaning step includes cleaning the component with hot water having a temperature of from about 175° F. to about 180° F. If desired, the method also may include the step of drying the component between the rinsing and buffing steps. Preferably, this drying step includes drying the component with hot air having a temperature of from about 200° F. to about 212° F. for a period of from about 10 minutes to about 15 minutes. Also, the component may be cooled after the drying step and before the buffing step. Preferably, the method further includes the step of applying a protective coating such as a lacquer or the like to the component after the buffing step. This protective coating typically is applied so as to have a coating thickness of about 2 mill.

One of the primary advantages of this antiquing method is its lower cost relative to other antiquing methods. For example, in its simplest form, the method requires only: contacting the metal component with an oxidizing solution; rinsing the solution from the metal component to stop the formation of additional oxide; and buffing the component to achieve the desired antique look. Therefore, fewer raw materials and method steps are required thereby saving both raw material and labor costs. In addition, the cost of regulatory compliance is significantly reduced using this method. Other benefits and advantages of the electroless antiquing method will become readily apparent to one of ordinary skill in the art upon review of the following detailed description of the invention.

DETAILED DESCRIPTION OF THE INVENTION

This invention is directed to a method of antiquing the surface of a zinc or pewter component. As used herein, the term "zinc" refers to zinc and zinc alloys having at least about 50% zinc. Such zinc alloys typically include various combinations of alloying metals such as copper, titanium, iron, lead, tin, aluminum, antimony, magnesium, manganese and the like. One suitable example of a zinc alloy is #3 Zinc Alloy AG40A ASTM B86 available from ARCO of Detroit, Mich. This alloy is a mixture of 66% Special High Grade 2400L Zinc (99.9% pure zinc) and 33% V12 Master Hardener. If desired, the Special High Grade 2400L Zinc and V12 Master Hardener may be purchased separately and mixed on location. The 2400L Zinc is available from Noranda of Toronto, Canada and the V12 Master Hardener may be obtained from ARCO of Detroit, Mich. With respect to the invention, the term "pewter" refers to alloys of tin in combination with one or more alloying metals such as antimony, copper, lead, bismuth, zinc, iron, nickel, aluminum and the like, with tin representing at least about 30% of the pewter. Suitable pewter alloys are available from Aim Products, Inc. of Smithfield, R.I. under the trade names 97

(97% tin, 2% antimony and 1% copper), 97SP (97% tin, 1.5% bismuth, 0.5% copper and other trace elements), and OR8 (92% tin, 7.5% antimony, 0.5% copper and other trace elements). An additional suitable pewter alloy is available from Belmont Metals, Inc. of Brooklyn, N.Y. under the trade name Britannia 7921 (91.75% tin, 8% antimony and 0.25% copper). As used herein, the term "component" refers to any metal piece, with non-limiting examples including castings, panels, sheets, molding and the like.

A preferred method for the high-production antiquing of zinc or pewter components according to the principles of the invention is described herein. This particular preferred embodiment is discussed with reference to the antiquing of escutcheon plates used on caskets, although the method may be modified and used to antique other components as will be understood by a person of ordinary skill in the art upon reading the following description.

In the preferred high-production antiquing method, the escutcheon plates or other components are loaded into a rack which is placed onto a conveyor system. The number of components loaded into the rack is a function of the rack size as well as the size of the particular components being finished. The conveyor moves the rack through a multistage washing system. This washing system is an enclosed area with several jets capable of spraying water or other solutions onto the components. If dirt is being removed from the components, they initially are sprayed with hot water. Then, the castings are sprayed with a cleaning solution, such as a solution of a mild soap and water. The castings then pass through three additional hot water rinses. If the metal castings have an oily residue, the cleaning process is modified somewhat. In order to remove this oil or grease, the castings are initially sprayed with a degreasing agent such as Secure, a phosphate cleaner available from Diversy U.S. Group (formerly Du Bois Chemical Co.) of Cincinnati, Ohio, which is then followed up by a standard soap solution. The castings then pass through three hot water rinse cycles. Although the water and various cleaning and degreasing solutions used may be of any temperature, it is advantageous for them to have a temperature of about 175° F. to about 180° F. At this temperature, the water and solutions do a better job of removing dirt and grease. Also, the subsequent drying stage goes more quickly because the components are already warm.

Once the components have been cleaned and rinsed, they are moved by the conveyor to a drying oven or tunnel. The oven or tunnel contains air blowers which blow air onto the components in order to remove the water. Preferably, the air is hot air having a temperature of about 200° F. to 212° F. and the parts are dried for a period of about 10–15 minutes. This drying step offers several advantages in forming the antiqued components. For example, if the components are submersed in an oxidizing solution in a subsequent step, this oxidizing solution will not be diluted with water from a prior washing step. In addition, the components are maintained at an elevated temperature in the drying stage, which results in a quicker oxidation reaction during the subsequent oxidizing step.

After drying, the conveyor moves the rack loaded with components over to an oxidizing tank filled with oxidizing solution. A suitable oxidizing solution is available from Electrochemical Products, Inc. of New Berlin, Wis., under the trade name B/OX 313. As supplied from the manufacturer, the B/OX 313 solution typically includes about 3.1% by weight copper chloride, about 1.1% by weight selenious acid, about 1.0% by weight hydrochloric acid and about 0.05% by weight sodium tetradecyl sulfate, with the balance being water. Although the B/OX 313 composition may be used as supplied by the manufacturer, the composition also may be used to advantage in the antiquing method in a more concentrated or a more diluted form. For example, in one form of the antiquing method, the B/OX 313 antiquing solution is diluted with water at a ratio of one part B/OX 313 to three parts water. This diluted antiquing solution generally has a composition of about 1.0% by weight copper chloride, about 0.37% by weight selenious acid, about 0.33% by weight hydrochloric acid and about 0.02% by weight sodium tetradecyl sulfate, with the balance being water. With this 1-to-3 dilution ratio, the metal components are submersed in the oxidizing solution tank for about 25 seconds. If B/OX 313 is diluted with more than three parts water, the reaction time needed to achieve a similar level of oxidation will be somewhat longer, while if the B/OX 313 solution is concentrated after it has been received from the vendor, the reaction time will be somewhat shorter.

After submersion in the oxidizing solution, the parts are moved by the conveyor to a hot water rinsing station. At this stage, the components are sprayed with water preferably having a temperature of about 175° F. to 180° F. Although any water temperature may be used, hot water is preferred because it allows the subsequent drying stage to proceed more quickly. The components are rinsed thoroughly in order to stop further oxidation of the exposed metal surfaces of the zinc or pewter.

The conveyor then moves the rack carrying the metal components into a drying oven or tunnel similar to the initial drying oven or tunnel discussed above. The oven contains air blowers which blow air onto the components in order to remove water and thoroughly dry the oxidation surface. This drying stage is advantageous because it reduces the possibility of smearing the oxide formed on the surface of the metal components. Preferably, the air is hot air having a temperature of about 200° F. to 212° F. and the parts are dried for a period of about 10–15 minutes.

After drying, the components are cooled to room temperature simply by allowing the components to cool passively. Typically, this cool-off period takes about 10 minutes, although the time may vary depending upon the temperatures used in the prior drying stage. Once the components have cooled to room temperature, the rack is removed from the conveyor and each component is removed from the rack and buffed by hand. The buffing may be done with any buffing, finishing or polishing pad such as, for example, an abrasive pad available from Anderlex Abrasives of Harvard, Ill. Any section or sections of the particular component may be buffed to achieve the desired antiquing affect. For example, on components having raised or elevated surface areas, it may be desirable to buff these raised sections while retaining a heavy layer of oxidation on the lower parts.

Once the components have been buffed, they are placed back into the rack which is then reconnected to the conveyor. The conveyor then takes the components to a top coat chamber where a protective top coat is applied to the components. The top coat chamber includes several disc coating guns positioned on the inner side walls of the chamber, which oscillate up and down while spraying protective material onto the components. Any protective lacquer or other protective material capable of sealing the oxidation on the components may be used and, if desired, a clear or tinted material may be used to achieve a particular color or look. An example of a suitable protective lacquer is Hardware Seal Coat 3117-3W available from Color Coatings Corporation of Chicago, Ill.

The time required for this top coat stage is a function of the desired thickness of the protective layer as well as the viscosity of the coating material, type of coating device and length of the coating chamber, as will be readily understood by one of ordinary skill in the art. Although the thickness of the protective coating may be varied as desired, it has been found that a thickness of about 2 mill (2/1000 of an inch) produces a durable product which performs extremely well over broad temperature and humidity ranges. In a particular top coat chamber or tunnel having a length of about 10 feet and employing disc coating guns having gun orifices of about 36/1000 inch in diameter, a coating thickness of about 2 mill may be achieved by moving the components through the top coat chamber over a period of about 25 seconds.

After the top coat layer has been applied, the parts are moved by conveyor to an infrared or hot air drying oven or chamber where the protective coating is dried. The drying time is a function of the particular lacquer, lacquer thickness, and type of drying process used as is readily understood in the art. For example, using an infrared oven at 250° F., it takes about 10 minutes to dry a protective lacquer coating having a thickness of about 2 mill. Following this drying step, the components are passively cooled to ambient room temperature, at which point they may be removed from the conveyor and rack, and packed for shipment.

In one particular application, the inventive antiquing method may be used to advantage to antique zinc or pewter components for use with funerary products. For example, such components may be any metal surface used on a casket, such as tips, arms, escutcheon plates (also known as lugs or ears), caps, bars, corner pieces, any other decorative parts, and even the casket itself. Other examples, include metal parts used on urns, such as handles, a base, decorative parts, detachable parts and even the urn itself.

The following example illustrates the durability of metal components antiqued using the inventive electroless antiquing process.

EXAMPLE

Sixty-five casket ears (also known as escutcheon plates or lugs) were antiqued using one form of the inventive method discussed above. The ears were die castings made of a zinc alloy of 66% Special High Grade 2400L Zinc (99.9% pure zinc) and 33% V12 Master Hardner. The ears first were loaded into racks (15 ears per rack) which were placed onto a conveyor system. The conveyer then moved the racks through a five stage washing system. In the first stage, dust and dirt were removed from the ears by spraying the ears with hot water. Then, in the second stage, the ears were sprayed with a cleaning solution of a mild soap and water. In the third, fourth and fifth stages, the ears passed through additional hot water rinses. In each of these five stages, the water or soap solution had a temperature of from about 175° F. to about 180° F.

Once the ears were cleaned and rinsed, they were moved in the racks by conveyor to a drying oven having hot air blowers. The ears were dried for about 10 to 15 minutes at a temperature of about 200° F. to 212° F.

After drying, the ears were moved by conveyor to an oxidizing tank filled with oxidizing solution. B/OX 313 from Electrochemical Products, Inc. of New Berlin, Wis., was used, and was diluted with water at a ratio of one part B/OX 313 to three parts water. Using this diluted oxidizing solution, the ears were submersed in the solution for about 25 seconds.

After submersion in the oxidizing solution the parts were moved by conveyor to a hot water rinsing station where they were sprayed with hot water having temperature of about 175° F. to about 180° F. The conveyor then moved the racks carrying the metal ears into a drying oven, where the ears were dried for a period of about 10 to 15 minutes using hot air blowers producing an air temperature of about 200° F. to 212° F.

After drying, the components were cooled to room temperature. by allowing components to cool passively for about 10 minutes. The racks then were removed from the conveyor, and each component was removed from the rack and buffed by hand using an abrasive pad available from Anderlex Abrasives, of Harvard, Ill. During this buffing stage, the raised or elevated surface areas of the ears were buffed in order to highlight these portions of the ears.

Once the components were buffed, they were placed back into the racks which were then reconnected to the conveyor. The components were then moved by conveyor to a top coat chamber having a length of about 10 feet and employing disc coating guns having gun orifices of about 36/1000 inch in diameter. During this top coat stage, the components or ears were given a protective lacquer coating having a thickness of about 2 mill using Hardware Seal Coat 3117-3W available from Color Coatings Corp., Chicago, Ill.

After the top coat layer was applied, the parts were moved by conveyor to an infrared drying oven having a temperature of about 250° F., where the ears were dried for about 10 minutes. Following this drying step, the components were passively cooled to ambient room temperature, at which point they were removed from the conveyor and racks.

After antiquing, all components satisfied ASTM standard D 3369 for adhesion. In order to evaluate the durability and longevity of the components, the ears subsequently were exposed to different humidity and temperature environments.

27 of the casket hardware ears were placed in a humidity chamber for 96 hours at 95° F. and 95% relative humidity. Another 15 ears were placed in an environmental chamber and subjected to 10 one-hour temperature cycles, with each cycle moving between −20° F. and 120° F. 12 of the ears were placed in an environmental chamber and subjected to a different temperature test of 10 one-hour cycles, with each cycle ranging between −35° F. and 60° F. In addition, 11 of the ears were placed in an environmental chamber and subjected to 10 one-hour temperature cycles with each cycle ranging between 80° F. and 180° F. Even after being subjected to these different environments, each of the ears still satisfied ASTM Standard D 3359 and, upon visual inspection, showed no bubbling or tarnishing.

Although the inventive antiquing method has been discussed in detail with respect to a high-production assembly line system, the antiquing steps may be performed using any of a number of set-ups and pieces of equipment as will be readily understood by one of ordinary skill in the art. Furthermore, the inventive method requires only a very few method steps in order to achieve an antiqued finish on the zinc or pewter component. These minimum steps include: contacting the metal component with the oxidizing solution; rinsing the component to remove the oxidizing solution after formation of the oxide; and buffing at least a portion of the component to achieve a desired highlighting or antiquing affect. Although the additional steps discussed in detail above may be used in a preferred embodiment of the antiquing method, the scope of the invention is determined by the following claims.

What is claimed is:

1. A method of antiquing a pewter component comprising the steps of:

forming an oxide on said component by contacting said component with an oxidizing solution comprising an acid salt of copper, selenious acid, hydrochloric acid and a surface activator;

rinsing said component to stop the formation of said oxide; and buffing said component to form an antique finish on said metal.

2. The method of claim 1 wherein said oxidizing solution comprises from about 0.3% to about 10% by weight acid salt of copper, from about 0.17% to about 1.9% by weight selenious acid, from about 0.2% to about 1.6% by weight hydrochloric acid and from about 0.003 to about 0.10% by weight surface activator, with the balance being water.

3. The method of claim 1 wherein said acid salt of copper is copper chloride and said surface activator is sodium tetradecyl sulfate.

4. The method of claim 3 wherein said oxidizing solution comprises from about 0.3% to about 10% by weight copper chloride, from about 0.17% to about 1.9% by weight selenious acid, from about 0.2% to about 1.6% by weight hydrochloric acid and from about 0.003% to about 0.10% by weight sodium tetradecyl sulfate, with the balance being water.

5. The method of claim 4 wherein said oxidizing solution comprises from about 1.0% to about 3.1% by weight copper chloride, from about 0.37% to about 1.1% by weight selenious acid, from about 0.33% to about 1.0% by weight hydrochloric acid and from about 0.02% to about 0.05% by weight sodium tetradecyl sulfate, with the balance being water.

6. The method of claim 5 wherein said oxidizing solution comprises about 1.0% by weight copper chloride, about 0.37% by weight selenious acid, about 0.33% by weight hydrochloric acid and about 0.02% by weight sodium tetradecyl sulfate, with the balance being water.

7. The method of claim 1 wherein said step of forming an oxide includes submersing said component into said oxidizing solution.

8. The method of claim 6 wherein said step of forming an oxide includes submersing said component into said oxidizing solution.

9. The method of claim 8 wherein said component is submersed in said oxidizing solution for about 25 seconds.

10. The method of claim 1 wherein said rinsing step includes rinsing said component with hot water having a temperature of from about 175° F. to about 180° F.

11. The method of claim 10 wherein said component is rinsed for about 30 seconds.

12. The method of claim 1 further comprising the step of cleaning said component prior to said step of forming an oxide.

13. The method of claim 12 wherein said cleaning step includes cleaning said component with hot water having a temperature of from about 175° F. to about 180° F.

14. The method of claim 1 further including the step of drying said component between said rinsing and buffing steps.

15. The method of claim 14 wherein said drying step includes drying said component with hot air having a temperature of from about 200° F. to about 212° F.

16. The method of claim 15 wherein said component is subjected to said drying step for a period of from about 10 minutes to about 15 minutes.

17. The method of claim 14 further including the step of cooling the component between said drying and buffing steps.

18. The method of claim 1 further including the step of applying a protective coating to said component after said buffing step.

19. The method of claim 18 wherein said protective coating is a lacquer.

20. The method of claim 18 wherein said protective coating is applied to said component so as to have a coating thickness of about 2 mill.

21. A method of antiquing a pewter component for use in a funerary product, comprising the steps of:

cleaning said component;

forming an oxide on said component by contacting said component with an oxidizing solution comprising copper chloride, selenious acid, hydrochloric acid and sodium tetradecyl sulfate;

rinsing said component to stop the formation of said oxide;

buffing said component to form an antique finish on said component; and applying a protective coating to said component after said buffing step.

* * * * *